US007112079B2

(12) United States Patent
Miura et al.

(10) Patent No.: US 7,112,079 B2
(45) Date of Patent: Sep. 26, 2006

(54) FLEXIBLE PRINTED CIRCUIT BOARD CONNECTOR

(75) Inventors: Kazuto Miura, Kanagawa (JP); Hiroshi Yamane, Kanagawa (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 11/257,362

(22) Filed: Oct. 25, 2005

(65) Prior Publication Data

US 2006/0089045 A1 Apr. 27, 2006

(30) Foreign Application Priority Data

Oct. 26, 2004 (JP) ..... 2004-311518

(51) Int. Cl.
*H01R 13/62* (2006.01)

(52) U.S. Cl. ..... 439/260; 439/495

(58) Field of Classification Search ..... 439/495, 439/260

See application file for complete search history.

(56) References Cited

U.S. PATENT DOCUMENTS

| | | | | |
|---|---|---|---|---|
| 5,695,360 | A * | 12/1997 | Seto et al. | 439/495 |
| 6,099,346 | A * | 8/2000 | Hashiguchi et al. | 439/495 |
| 6,514,101 | B1 * | 2/2003 | Miura | 439/495 |
| 6,551,128 | B1 * | 4/2003 | Asai | 439/495 |
| 6,726,497 | B1 * | 4/2004 | Nogawa et al. | 439/260 |
| 6,755,682 | B1 * | 6/2004 | Kunishi et al. | 439/495 |
| 6,767,233 | B1 * | 7/2004 | Tsunematsu | 439/260 |
| 6,837,740 | B1 * | 1/2005 | Kunishi et al. | 439/495 |
| 6,893,288 | B1 * | 5/2005 | Tsunematsu | 439/495 |
| 6,949,316 | B1 * | 9/2005 | Aoki | 439/260 |

FOREIGN PATENT DOCUMENTS

| | | | |
|---|---|---|---|
| JP | H10-228957 | A | 8/1998 |
| JP | 2000-100507 | A | 4/2000 |
| JP | 2001-110483 | A | 4/2001 |
| JP | 2002-134195 | A | 5/2002 |
| JP | 2002-141126 | A | 5/2002 |
| JP | 2002-231350 | A | 8/2002 |
| JP | 2002-329536 | A | 11/2002 |
| JP | 2003-109695 | A | 4/2003 |
| JP | 2003-109696 | A | 4/2003 |
| JP | 2003-151660 | A | 5/2003 |
| JP | 2003-151662 | A | 5/2003 |
| JP | 2003-297465 | A | 10/2003 |
| JP | 2004-087361 | A | 3/2004 |
| JP | 2004-192825 | A | 7/2004 |
| JP | 2004-193045 | A | 7/2004 |

* cited by examiner

*Primary Examiner*—Tulsidas C. Patel
*Assistant Examiner*—Harshad Patel
(74) *Attorney, Agent, or Firm*—Rader, Fishman & Grauer PLLC

(57) ABSTRACT

A connector comprises a housing and a cover housing. The housing has a recess formed for insertion of a FPC. The housing comprises a first contact, a second contact and a third contact. The first contact and the second contact includes a first arm, a second arm, and a horizontal leg. The third contact includes a fixing arm, an elastic arm opposing the fixing arm, and a connection leg connecting said fixing arm with said elastic arm. A cam is arranged between the elastic arm of the third contact and the bottom surface of the recess of the housing for locking at a tip of the elastic arm.

8 Claims, 10 Drawing Sheets

PRIOR ART

PRIOR ART

FLEXIBLE PRINTED CIRCUIT BOARD CONNECTOR

CROSS-REFERENCE TO RELATED APPLICATIONS

Priority is claimed on Japanese Patent Application No. 2004-311518, filed Oct. 26, 2004, the content of which is incorporated herein by reference.

BACKGROUND OF THE INVENTION

1. Field of the Invention

The present invention relates to a connector to be connected to flexible, planar cables such as FPC (Flexible Printed Circuit) or FFC (Flexible Flat Cable). Hereinafter in this specification, a flexible, planar cable will be generically referred to as a FPC. Furthermore, the present invention relates to a connector for FPC of ZIF (Zero Insertion Force) type, that hardly needs any force for insertion and removal of the FPC.

2. Description of Related Art

In recent years, a connection between electronics modules or print substrates implemented in electronic equipment such as DVC (Digital Video Camera) and DSC (Digital Still Camera) or mobile information equipment represented by mobile phone and PDA (Personal Digital Assistance), a FPC, a flexible and planar cable, has been adopted.

A connector for FPC to be implemented on the surface of a printed circuit board, i.e., a surface mounted connector for FPC, comprises an insulative housing having an insertion portion formed for the insertion of FPC, and a plurality of contacts attached side by side in a predetermined pitch to the housing. In order for contacting the FPC with these contacts, a covering housing that can open and close is provided in the insertion portion.

The connector for FPC to be mounted on the surface of a printed circuit board, in order to attain a higher density, is required to have a lower height (a reduction in profile). The contacts that are aligned in the surface mounted type connector for FPC are increasingly made with more pins in a finer pitch therebetween.

As such surface mounted type connector for FPC, a connector has been invented (see, for example, Japanese Patent Application Laid-Open No. 2002-329536) wherein a plurality of contacts that comprises a contact leg contacting the FPC, and a stabilizer leg corresponding to the contact leg is configured in a first contact group and a second contact group that align in parallel with each other.

The connector for FPC according to Japanese Patent Application Laid-Open No. 2002-329536 is provided with a cam that engages the stabilizer leg in the first contact group at an actuator (hereinafter referred to as a cover housing) that opens and closes, and a pressed portion that engages the stabilizer leg in the second contact group.

The cam that is formed around a pivot shaft of the cover housing is elastically deformed such that the stabilizer leg in the first contact group widens the interval between the corresponding contact legs when the pivot shaft rotates to move the cover housing from the closed position to the opening position.

On the other hand, the pressed portion is formed in such a way that the stabilizer leg in the second contact group receives a force that is in an opposing direction of the force given by the stabilizer leg in the first contact group to the cover housing when the pivot shaft rotates to move the cover housing from the closed position to the opened position.

When the cover housing is rotated to open the insertion portion of the FPC, the connector for FPC according to Japanese Patent Application Laid-Open No. 2002-329536, elastically deforms the stabilizer leg of the first contact group and widens an interval between the contact leg and the pressing portion of the FPC provided in the stabilizer leg. The literature also describes that the deformation of the cover housing can thus be prevented or controlled without damaging the ZIF action.

In addition, Japanese Patent Application Laid-Open No. 2002-329536 describes about the connector for FPC that the first contact group and the second contact group will not give the cover housing any force that causes adverse deformation under a state where the cover housing is closed.

As such surface mounted type connector for FPC, a connector has been invented (see, for example, Japanese Patent Application Laid-Open No. 2003-151660) that comprises an insulative housing, a plurality of contacts installed in the housing, and the cover housing rotatably provided thereto.

The contact of the connector for FPC according to Japanese Patent Application Laid-Open No. 2003-151660 comprises a contact beam extending toward the insertion portion of the FPC and a pivot beam. The lower edge of the tip side of the pivot beam is formed with a notch to construct the pivot portion of the cover housing.

Furthermore, in the connector for FPC according to Japanese Patent Application Laid-Open No. 2003-151660, a through hole is formed corresponding to the pivot portion of each contact in the cover housing. The circumference of the through hole is described as an axial portion of which cross-section is approximately circular and engages the pivot portion. A protrusion for pressurization is provided between the adjacent axial portions to press the FPC toward a direction of the contact point of the contact.

In such configuration of the connector for FPC according to Japanese Patent Application Laid-Open No. 2003-151660, the cover housing is easily assembled to the housing, and at the same time, will not damage the contact point of the contact during assembly.

FIG. 14 is a sectional view of a connector 7 for FPC according to Japanese Patent Application Laid-Open No. 2002-329536. FIG. 14 in the present invention corresponds to FIG. 3 in Japanese Patent Application Laid-Open No. 2002-329536. In FIG. 14, a housing 70 includes an insertion portion 70A in which FPC 1 is inserted. A first contact leg 71A in the first contact 71 is pressed from the insertion portion 70A side into the housing 70. One end of the first contact leg 71A forms a lead portion extending from the housing 70 and solder jointed to a printed circuit board 9.

As shown in FIG. 14, the other end of the first contact leg 71A is inverted and branched in U-shape to form a first stabilizer leg 71B that extends to a side of insertion portion 70A. The tip of the first stabilizer leg 71B then engages a cam 73A that is formed in the circumference of the pivot shaft of the cover housing 73.

FIG. 15 is a sectional view of a connector 7 for FPC according to Japanese Patent Application Laid-Open No. 2002-329536. FIG. 15 in the present invention corresponds to FIG. 4 in Japanese Patent Application Laid-Open No. 2002-329536. In FIG. 15, the second contact 72 have a second contact leg 72A and a second stabilizer leg 72B disposed opposingly with each other, one end of the second contact leg 72A and one end of the second stabilizer leg 72B are connected to form a bifurcated contact.

As shown in FIG. 15, the second stabilizer leg 72B is pressed from an opposing side of the insertion portion 70A into the housing 70. The other end of the second stabilizer leg 72B is a free end that extends from the housing 70. The free end engages a pressed portion 73B that is formed in the circumference of the pivot shaft of the cover housing 73. One end of the second contact leg 72A extends from the housing 70 to form a lead portion that is solder jointed to a printed circuit board 9 (refer to FIG. 14)

The contacts aligned in the surface mounted type connector for FPC are increasingly made with more pins in a finer pitch therebetween. Accordingly, the contacts 71 and 72 shown in FIGS. 14 and 15 are plate springs that are thin in plate thickness. In addition, the contacts aligned in the surface mounted type connector for FPC are reducing its height and having finer pitch therebetween. To cope with this development, a wall C between polar (in a shape of the teeth of comb) of the housing 70 that holds a fixed end of the second stabilizer leg 72B shown in FIG. 15, for example, is made thinner.

In FIG. 14, when the cover housing 73 is opened, a cam 73A formed in the circumference of the pivot shaft of the cover housing 73 to act as a eccentric cam rotates to dispose the end of the first stabilizer leg 71 B in an upper position. In brief, as shown in FIG. 14, upon rotation of cam 73A in the pivot shaft of the cover housing 73, an upward force R acts.

On the other hand, as shown in FIG. 14, an opposing force S acts when the first stabilizer leg 71 B tries to have its end portion return to its position. Accordingly, as shown in FIG. 15, when the opposing force S acts, the pressed portion 73 B that is to be integrated with the pivot shaft of the cover housing 73 energizes a tip of the second stabilizer leg 72 B into a downward direction.

Upon opening the cover housing 73, the second stabilizer leg 72 B generates a bending moment in a counter clockwise direction with a lead portion (a lead portion to be an end of the second contact leg 72A) solder jointed to the printed circuit board 9 (refer to FIG. 14) as a supporting point.

As described above, because the wall C between electrodes of the housing that holds a fixed end of the second stabilizer 72B is thin, a stress acts upon a thin wall C between electrodes that have the second contact 72 pressed therein, therefore tending to cause a breakage problem.

Further reduction of the profile in the surface mounted connector for FPC results smaller sectional area of the cam 73B that is to form an eccentric cam. Additionally, as a contact provided with more pins is increasingly sought, it causes a longer pivot shaft that connects cam 73A in an axial direction.

It is feared that, in a process of opening the cover housing 73, such a long length of pivot shaft will be deformed at the center portion due to the opposing forces S on a number of the first stabilizer legs 71 B. Specifically, it is feared that the pivot shaft will have the center portion deformed by way of action of equally distributed load across the end of support beam. It is conceivable that the deformed center portion of the pivot shaft may cause difficulty in opening the cover housing 73.

It is desirable that a ZIF type connector for FPC has more pins in finer pitch with a reduced profile, and also is configured to ensure the opening and closing operation of the cover housing.

FIG. 16 is a sectional view of a connector for FPC 8 according to Japanese Patent Application Laid-Open No. 2003–151660. The FIG. 16 of the present invention corresponds to FIG. 3 in Japanese Patent Application Laid-Open No. 2003-151660. In FIG. 16, the housing 80 have the insertion portion 80A in which the FPC 1 is inserted. Contact beam 81A and pivot beam 81B forming a terminal (hereinafter, referred to as a contact) 81 are pressed into the housing 80 from the opposing side of the insertion portion 80A. An end portion of the contact beam 81A forms a lead portion extending from the housing 80 and solder jointed to the printed circuit board (not shown).

FIG. 16 is a state diagram showing a cover housing 83 in an opened position. As shown in FIG. 16, a notch 811 is formed at a lower edge of the tip of the pivot beam 81B. A pivot portion 812 that rotatably supports a shaft 83A of the pivot shaft of the cover housing 83 forms a notch 811. A through hole 831 is provided around the shaft 83A.

FIG. 17 is a sectional view of a connector for FPC 8 according to Japanese Patent Application Laid-Open No. 2003–151660. The FIG. 17 of the present invention corresponds to FIG. 4 in Japanese Patent Application Laid-Open No. 2003-151660. FIG. 17 is a state diagram showing a cover housing 83 in a closed position. As shown in FIG. 17, a pressure protrusion 832 formed at a bottom wall of the cover housing 83 presses FPC1.

In the connector 8 according to Japanese Patent Application Laid-Open No. 2003-151660, the opening size A of the through hole 831 to be formed in the cover housing 83 is made smaller than the size B in a height direction of the pivot portion 812 of the contact 81 in a way that the cover housing 83 will not come off from the pivot portion 812 of the contact housing 83 during opening and closing of the cover housing 83. As a result, the connector for FPC will be achieved with reliable connecting operation of the FPC The contact that is aligned in the surface mounted type connector for FPC are increasingly made with more pins in a finer pitch therebetween. Accordingly, the contact 81 in FIGS. 16 and 17 are plate springs that are thin in plate thickness. In addition, the surface mounted type connector for FPC is reducing its height. The thickness of the housing 80 that holds a fixed end of the pivot beam 81B shown in FIG. 16, for example, is made thinner.

In the connector 8 shown in FIGS. 16 and 17, a plurality of contacts 81 is aligned in a line in the housing 80. In a state where the FPC 1 is inserted into the connector 8 and the cover housing 83 is closed, as a result of the contact beam 81A, a bending moment in a counter clock direction acts upon the pivot beam 81B of a cantilever beam.

The pivot beam 81B of a cantilever beam as in a shape shown in FIGS. 16 and 17, however, when the thickness of the plate is made thinner and the profile is reduced, cannot be a rigid arm having large geometrical moment of inertia that can counteract the aforementioned bending moment.

Stated differently, it cannot counter the concern that the pivot beam 81B of a cantilever beam undergoes uniformly distributed load of deflection in an upper direction. This may cause a problem of, for example, a contact failure between the FPC and the contact.

In a connector for FPC having contacts that has more pins in a finer pitch therebetween and with a low profile, it is desirable that the connector for FPC is configured to have a cover housing that can maintain reliable opening and closing position to avoid contact failure.

In view of these problems, it is an object of the present invention to provide a connector for FPC having contact that has more pins in a finer pitch therebetween and with a low profile, and that is configured to ensure the opening and closing operation of the cover housing, and at the same time, to maintain its opening and closing position.

SUMMARY OF THE INVENTION

In order to satisfy the above object, inventors of the present invention invented a novel connector for FPC comprising a plurality of first contact and second contact sandwiching pivot shaft that counteracts the deflection of the pivot shaft of the cover housing. The plurality of first and second contacts is alternately disposed in parallel. In this configuration, a plurality of third contact is arranged between the first and second contacts.

(1) 1. A connector comprising:

a housing and a cover housing, the housing being generally rectangular parallelepiped in shape and having a recess formed for insertion of a FPC, the cover housing being generally rectangular in shape for openably and closably covering said recess of the housing;

said housing comprising a first contact, a second contact and a third contact therein, the first and the second contacts being alternatively disposed, the third contact being disposed between a pair of said first and second contacts situating adjacent to each other;

said first contact and said second contact including a first arm, a second arm, and a horizontal leg, the first arm and the second arm extending in a direction facing toward each other, the horizontal leg connecting the base end of the first and the second arm;

said third contact including a fixing arm, an elastic arm opposing the fixing arm, and a connection leg connecting said fixing arm with said elastic arm;

said second arm of the first contact having at tip a receiving portion extending toward a direction opposing a bottom surface of the recess of said housing; and said second arm of the second contact having at tip a pressing portion extending toward a bottom surface of the recess of said housing; and said cover housing comprising an engaging portion, a supporting portion, and a cam, the engaging portion extending toward a bottom surface side of the recess of said housing for engaging a receiving portion of said first contact, the supporting portion arranged between the pressing portion of said second contact and the bottom surface of the recess of said housing, and pressed by said pressing portion, the cam arranged between the elastic arm of said third contact and the bottom surface of the recess of said housing for locking at a tip of said elastic arm, wherein said first arm pivots adjacent to a front end of said housing.

The connector according to the invention (1) comprises a generally rectangular parallelepiped shaped housing having a recess in which the FPC is inserted formed therein. The connector may be conductively connected to the FPC that is inserted into the recess of the housing, and the housing has insulating properties. The recess, for example, has one end opened and other end formed with an insertion portion in which insertion end portion of the FPC abuts.

As for FPC, a copper foil of a conductive pattern is adhered on a base film that is formed of an insulative polyester or polyimide. The conductive pattern is coated with an insulating coating, whereas the end portion of the FPC have a conductive pattern exposed to conductively contact to the contact provided in the connector. The FPC to be applied to the connector according to the present invention is preferably a double sided FPC provided with conductive patterns on both sides of the base film, wherein the end portions of the double sided FPC have conductive patterns on both sides of the base film.

Above-mentioned housing having insulative properties may be a housing made of non-conductive materials. Engineering plastics such as PPS (polyphenylene sulfide) and PBT (polybutylene terephthalate), for example, may be molded to obtain such housing having insulative properties.

In the generally rectangular parallelepiped housing, a recess in a thin rectangular parallelepiped shape is formed and in which the FPC is inserted. The FPC is inserted from the opening portion of the recess toward the insertion portion. When the FPC is inserted into the recess, an opposing pair of vertically arranged wall forming the recess, for example, may guide the FPC in a direction of width, and be aligned with a plurality of the first through third contacts that will be described later.

In the insertion portion, for example, a U shaped groove may be formed so that the insertion end portion of the FPC will be inserted, and a stop wall abutting to the insertion end portion of the FPC may be provided on the bottom surface of the U shaped groove. Such stop wall may be provided in pairs so that the stop wall abuts both ends of the insertion end portion of the FPC. The stop wall may also be provided in walls between electrodes of a plurality of first through third contacts in a shape of the teeth of comb as will be described later.

In order to allow the FPC to be inserted and inclined with a predetermined opening angle from the bottom surface, the insertion portion has a thickness slightly larger than that of the FPC and may have a slope formed on a surface opposing to the bottom surface of the recess. In addition, the connector is configured with a ZIF connector that hardly needs any force upon insertion and removal of FPC to and from the insertion portion.

The connector according to the invention (1) comprises a cover housing of generally rectangular shape that openably and closably covers the recess of the housing. For example, one end of the cover housing is provided with a pivot shaft, and both ends of the pivot shaft are rotatably supported by the housing. The other end of the cover housing opens and closes the opening portion of the recess.

It can be considered that the pivot shaft is made of non-conductive materials integrated with the cover housing. On both sides of one end of the cover housing, for example, a pair of cylindrical protrusions to be coaxial with the pivot shaft is disposed in a way that the pair of cylindrical protrusions may be rotatably supported by both ends to the housing. Alternatively, a pair of supporting member to be pressed into the housing (for example, a pair of tabs that will be described later) may rotatably support the pair of cylindrical protrusions.

The description "the cover housing covers the recess in a way capable of opening and closing" refers to that the cover housing that covers the recess is opened to have the FPC inserted therein, and that the cover housing closes to cover the recess so that the cover housing presses the FPC toward the bottom surface of the recess, resulting in conductive contact of the below-mentioned plurality of first to third contacts and the FPC. A locking mechanism may be provided with the connector in order to maintain the closing position.

The housing comprises a first contact and a second contact alternatively disposed in parallel therein. A third contact is disposed between a pair of the first and second contacts situating adjacent to each other;

In the housing, for example, a plurality of longitudinal rectangular grooves is formed in a shape of the teeth of comb from the opening of the recess to the insertion portion, and further in a rear direction of the insertion portion. The first contact and the second contact is pressed from the opening of the recess into the longitudinal rectangular grooves, and alternatively disposed in parallel.

The longitudinal rectangular groove, for example, has a width slightly larger than the plate thickness of the first contact and the second contact so that the first arm may deflect within a certain specific distance from the opening of the recess. Beyond the distance, the width of the groove is slightly smaller than the plate thickness of the first and the second contact. In the rear portion of the housing (opposing side of the recess), it can be said that the first and the second contact in the upper and lower direction is pressed into the housing.

The first and the second contact may have an equal plate thickness, for example. The second contact may be inserted into the longitudinal rectangular groove in which the first contact is to be inserted. Alternatively, the first contact may be inserted into the longitudinal rectangular groove in which the second contact is to be inserted.

The third contact may be pressed into the housing from the opposite side of the recess. The third contact is disposed between the adjacent pair of the first contact and the second contact. The arrangement of the third contact between the adjacent pair of the first contact and the second contact includes a case where the third contact is disposed having the first contact adjacent thereto, or a case where the second contact is disposed having the third contact adjacent thereto.

The first contact and the second contact have a first arm and a second arm respectively extending toward each other. Additionally, the first contact and second contact have a horizontal leg connecting proximal ends of the first arm and second arm.

The first arm, for example, is stood and branched from an end of the horizontal leg and is further extended and branched toward the insertion portion. The extending end of the first arm is provided with a first point that extends from the bottom surface of the recess and elastically contacts with the FPC. The second arm is stood and branched from the other end of the horizontal leg and is further extended and branched toward the second arm. The connection of the proximal ends of the first and second arms by a horizontal leg means that the first arm and the second arm has a function of spring that serves as cantilever beam, or a so-called cantilever.

For example, a U-shaped groove is formed by a horizontal leg and the second arm that are opposing with each other on the other end of the first and second contact in a way that the groove surrounds the contour of the insertion portion that is to be abut by the insertion end portion of the FPC. The first and second contacts have a larger width so that the FPC can be inserted in a portion of which contour is a U-shaped groove.

The third contact comprises a fixing arm, an elastic arm opposing to the fixing arm, and a connection leg having one end connecting to the fixing arm and other end connecting to said elastic arm. The fixing arm, for example, is pressed from the opposing side of the recess into the housing to be fixed thereto. The elastic arm is provided with the second contact point that extends toward the bottom surface of the recess to elastically contact with the FPC. In a state where the fixing arm is pressed into the housing, the elastic arm has a function of spring that serves as a so-called cantilever contact.

The second arm of the first contact has at a tip side a receiving portion extending in a direction opposing to the bottom surface of the recess of the housing. On the other hand, the cover housing has an engaging portion that extends toward the bottom surface side of the recess of the housing and engages the receiving portion of the first contact.

The second arm of the first contact, for example, has at a tip side an arc-shaped receiving portion that rotatably engages the engaging portion of a pivot shaft of the cover housing. The engaging portion of pivot shaft is supported by an arc-shaped receiving portion in a direction opposing to the bottom surface of the recess. The extension of the receiving portion in a direction opposing to the bottom surface of the recess means that the arc-shaped receiving portion opens in a direction away from the recess in a way that the cylindrical engaging portion will be out of the receiving portion.

The second arm of the second contact has at a tip side a pressing portion extending toward the bottom surface side of the recess. On the other hand, the cover housing comprises a supporting portion that is disposed between the pressing portion of the second contact and the bottom surface of the recess of the housing, and pressed by the pressing portion.

The second arm of the second contact has at its tip side a straight tooth-like pressing portion that rotatably press the supporting portion of the pivot shaft in the cover housing. The pressing portion presses the supporting portion of the pivot shaft against a direction away from the bottom surface of the recess. The extension of the pressing portion toward the bottom surface side of the recess means that the supporting portion does not contact the straight tooth-like pressing portion in a direction toward the bottom surface of the recess so that the supporting portion will be out of the straight tooth-like pressing portion.

The cover housing further comprises a cam disposed between the elastic arm of the third contact and the bottom surface of the recess for locking at a tip side of the elastic arm. The tip side of the elastic arm locks at the cam to maintain the opening and closing position of the cover housing.

The cam portion is a plate cam having a plane curve as its contour, and formed around the circumference of the pivot shaft. The cam also serves as an eccentric cam having a portion of the contour deviated from the center axis of the pivot shaft. The tip of the elastic arm is a follower to be displaced due to a rotational movement of the cam.

In a case where the FPC is not inserted into the housing, and at the same time the cover housing is closed, the tip of the elastic arm locks at the cam to maintain the closed position. On the contrary, in a case where the FPC is not inserted into the housing, and at the same time the cover housing is opened, the tip side of the elastic arm locks at the cam to maintain the opened position. The cover housing has an opening angle at 90 degrees or more, for example, up to approximately 120 degrees.

When the cover housing is opened, the tip side of elastic arm as well as the second contact is elastically deformed in a direction away from the bottom surface of the recess. With this, the FPC can be inserted between the bottom surface of the recess and the second contact point. When the FPC is inserted and the cover housing is closed, the second contact elastically returns so that a plurality of the second contacts elastically contact with the FPC. At this point, the tip side of the elastic arm is away from the cam.

Here, the pivot shaft in the cover housing comprises an engaging portion that engages the receiving portion of the first contact, a supporting portion to be pressed by the pressing portion of the second contact, and a cam locking at the tip side of the elastic arm in the third contact. The pivot shaft in the cover housing further comprises a pair of cylindrical protrusions that is disposed at both sides on one end portion of the cover housing. Such engagement portion, support portion, cam, and cylindrical protrusions are disposed in an axial direction of the pivot shaft.

In the connector according to the invention (1), a plurality of the third contact may be arranged in parallel in a certain interval, and at a same time a plurality of the first contact and a plurality of the second contact may be alternatively arranged in parallel in an interval equal to the interval of the first and the second contacts as shown above between the plurality of the third contacts. In this arrangement, when the cover housing is opened, a plurality of receiving portions support the pivot shaft, resisting to a force given to the pivot shaft by a plurality of the elastic arms. When the FPC is inserted and the cover housing is closed, a plurality of pressing portions press the pivot shaft, resisting to a force that is given to the pivot shaft by a plurality of the supporting portions.

The parallel arrangement described here means that the contacts are adjacent to each other and aligned in a line. A certain interval may be equal with the interval of the conductive pattern of FPC (A conductive pattern disposed at an end of the FPC). Here, the plurality of the first contacts and the plurality of the second contacts disposed between the plurality of the third contacts are alternatively arranged in parallel with a half pitch displacement from the plurality of the third contacts.

It may be considered that the plurality of the first contacts and the plurality of second contacts contact with the conductive pattern that exposes on one surface of the double sided FPC, and the plurality of the third contacts contact with the conductive pattern that exposes on the other surface that opposes one surface of the double sided FPC.

When the cover housing is opened, a plurality of elastic arms having both ends supported locks the cams of pivot shaft, and uniformly distributed load is acted thereupon. The uniformly distributed load acts as a force wherein the pivot shaft moves toward the recess. On the other hand, a plurality of receiving portions engage the engaging portion of the pivot shaft in a direction against the pivot shaft that moves toward the recess in such a way that the central portion in an axial direction of the pivot shaft will not be deflected and thus allowing easy opening operation of the cover housing.

When the FPC is inserted and the cover housing is closed, the pivot shaft having both ends supported is pressed by a plurality of the first contact point and the uniformly distributed load acts. The uniformly distributed load acts as a force wherein the pivot shaft moves away from the recess. On the other hand, a plurality of pressing portions press the supporting portion of the pivot shaft in a direction against the pivot shaft moving away from the recess in such a way that the central portion in an axial direction of the pivot shaft will not be deflected and thus allowing closing operation of the cover housing. This also serves to prevent the contact failure of the first contact point.

Furthermore, the fixed end of the elastic arm is not supported by the housing, however, the elastic arm is built variably in the housing. Conventionally, for example, the stress acts in a way that the compression buckling on the wall between electrodes of the housing that holds the fixed end of the stabilizer leg tends to cause breakage, however, the connector for FPC having above mentioned configurations can overcome such disadvantage.

With such configurations of the connector for FPC, wherein the contact has more pins in finer pitch and the connector is lower in height, the pivot shaft of the cover housing that opens and closes will not be displaced. Such connector for FPC can prevent the contact failure of the contact due to the displacement of the pivot shaft.

(2) A connector according to invention (1), wherein the second arm of said first contact and the second arm of said second contact is a rigid arm having large geometrical moment of inertia.

The tip side of the second arm in the first contact comprises a receiving portion that engages the engaging portion. When the cover housing is opened, the receiving portion engages the engaging portion in a direction opposing to the engaging portion that moves toward the bottom surface of the recess. The second arm of the first contact is a rigid arm having large geometrical moment of inertia.

The tip side of the second arm in the second contact comprises a pressing portion that presses the supporting portion. When the cover housing is closed, the pressing portion presses the supporting portion in a direction opposing to the supporting portion that moves away from the bottom surface of the recess. The second arm of the second contact is a rigid arm having large geometrical moment of inertia.

The second arm is a cantilever beam having a receiving portion of free end on which load is acted upon. Assuming that the rectangular cross sectional surface, for example, has a plate thickness of "b" and a plate width of "h", the geometrical moment of inertia I of the second arm is calculated with a formula I=bh3/12. The widened second arm has a cross sectional shape with larger geometrical moment of inertia. In addition, the extending end of the second arm shortens the extending distance from the housing, and decreases the amount of deflection in the receiving portion and pressing portion upon which load is acted.

In the second arm having such configuration, when the cover housing is opened, the receiving portion supports the pivot shaft in a direction against the pivot shaft moving toward the recess. That is, a plurality of second arms of the first contacts, that is a rigid arm having large geometrical moment of inertia, supports the pivot shaft in a way that the pivot shaft upon which equally distributed load is acted will not be displaced in a direction toward the recess.

In the second arm having such configuration, when the FPC is inserted and the cover housing is closed, the pressing portion supports the pivot shaft in a direction against the pivot shaft that moves away from the recess. That is, a plurality of second arms of the second contacts, that is a rigid arm having large geometrical moment of inertia, supports the pivot shaft in a way that the pivot shaft upon which equally distributed load is acted will not be displaced in a direction away from the recess.

(3) A connector according to invention (1) or (2), wherein said cam comprises a first contour and a second contour, the first contour maintains the closed position of said cover housing, and the second contour continues from the first contour and maintains the opened position of said cover housing, upon a tip side of said elastic arm engaging the second contour, the tip side of the elastic arm is elastically deformed in a direction away from a bottom surface of said recess for allowing of insertion and removal of said FPC.

The connector according to the invention of (3), the cam comprises a first contour that maintains the closing position of the cover housing. The cam further comprises a second contour that maintains the opening position of the cover housing continuously from the first contour. When the tip side of the elastic arm engages the second contour, the tip side of the elastic arm is elastically deformed in a direction away from the bottom surface of the recess in such a way that the FPC can be inserted and removed.

When the FPC is not inserted and the cover housing is closed, the tip side of the elastic arm abuts the first contour and maintains the closed position of the cover housing. When the cover housing is opened, the second contour disposed away from the center of the axis of the pivot shaft elastically displaces the tip side of the elastic arm. Due to a returning force of the elastic arm, the tip side of the elastic arm energizes the second contour, therefore maintaining the opened position of the cover housing.

(4) A connector according to any one of inventions (1) to (3), wherein third contour that is continuous from said first contour and second contour forms a pressing portion that presses said FPC against the bottom surface side of said recess.

The connector according to the invention of (4), the third contour that is continuous from the first contour and the second contour forms a pressing portion in which the FPC is pressed toward the bottom surface side of the recess.

The first contact point extending from the bottom surface side of the recess, for example, is preferably disposed directly under the center of the axis of the pivot shaft in order to ensure the contact with the FPC. It is more preferable that the first contact point is disposed at a point directly under and beyond the center of the axis of the pivot shaft in order that the first contact point is rotated in a direction where the cover housing is closed. In relation to the first contact point that is suitably disposed as described above, the third contour that is formed in the circumference of the cam presses the FPC toward the bottom surface side of the recess to ensure the contact with the FPC.

(5) A connector according to any one of inventions (1) to (4), wherein said first and second contact includes a first lead and second lead extending from the opening side of said recess toward a direction opposing to the insertion of said FPC, and said third contact includes a third lead extending from the opposing side of opening side of said recess toward a direction of the insertion of said FPC, the bottom surfaces of the first to third leads are connected to a printed circuit board.

In the connector according to the invention of (5), the first and the second contacts comprise a first lead and a second lead extending from the opening side of the recess toward a direction opposing to the insertion of the FPC. The third contact comprises a third lead extending from the opposing side of the recess toward a direction of the insertion of the FPC. On the other hand, the bottom surfaces of the first to the third leads are, for example, solder jointed to printed circuit board.

The connector has a plurality of the first to third leads solder jointed to the printed circuit board. The connector thus achieves a connector for printed circuit board on which the connector is surface mounted to the printed circuit board.

Further, because the first lead and the second lead, and the third lead is distributed in an inverted two directions, the pitch between the patterns connected to the first through the third leads can be made wider in comparison with the case where the first and second leads, and the third lead extends into one direction. In particular, it is effective that the pitch between the patterns is as finer as approximately 0.2 mm.

(6) A connector according to any one of inventions (1) to (5), wherein said connector includes a pair of tabs disposed on both sides of said housing and rotatably support pivot shafts that are formed on both ends of said cover housing, the pair of tabs having bottom surface connected to said printed circuit board.

The connector according to the invention (6) is disposed on both sides and comprises a pair of tabs that rotatably support the pivot shaft that is formed on both ends of said cover housing.

The pair of tabs may be formed of metal materials that can be easily solder jointed to printed circuit board, or may be formed of a rigid metal plate that can be pressed into the housing. The pair of tabs supports the pivot shaft at both ends and is pressed into the housing to be connected to the printed circuit board, and therefore complementing the connection strength of the connector to the printed circuit board.

(7) A connector according to any one of inventions (1) to (6), wherein said connector is capable of conductive connection with double sided FPC in which a pitch between the patterns is approximately 0.2 mm.

(8) A connector according to any one of inventions (1) to (7), wherein said connector is capable of conductive connection with double sided FPC that have eighty conductor lines.

The connector according to the present invention is a low profile connector for FPC and comprises a contact that has more pins in finer pitch therebetween. The connector further comprises a plurality of first and second contacts alternatively disposed in parallel, and sandwiches the pivot shaft in a direction opposing to the deflection of the pivot shaft in a way that the pivot shaft in the cover housing will not be displaced. In addition, a plurality of the third contacts that maintains the opening and closing position of the cover housing is disposed between the first and the second contact. Under such configuration, the opening and closing operations of the cover housing is ensured and the contact point can contact the FPC in a correct and ensured manner.

Furthermore, the fixed end of the elastic arm is not supported by the housing, however, the elastic arm is built variably in the housing. Conventionally, for example, the stress acts in a way that the compression buckling on the wall between electrodes of the housing that holds the fixed end of the stabilizer leg tends to cause breakage, however, the connector for FPC having above mentioned configurations can overcome such disadvantage.

DETAILED DESCRIPTION OF THE INVENTION

With reference to drawings, best mode for carrying out the invention will be described hereinafter.

Figure 1:
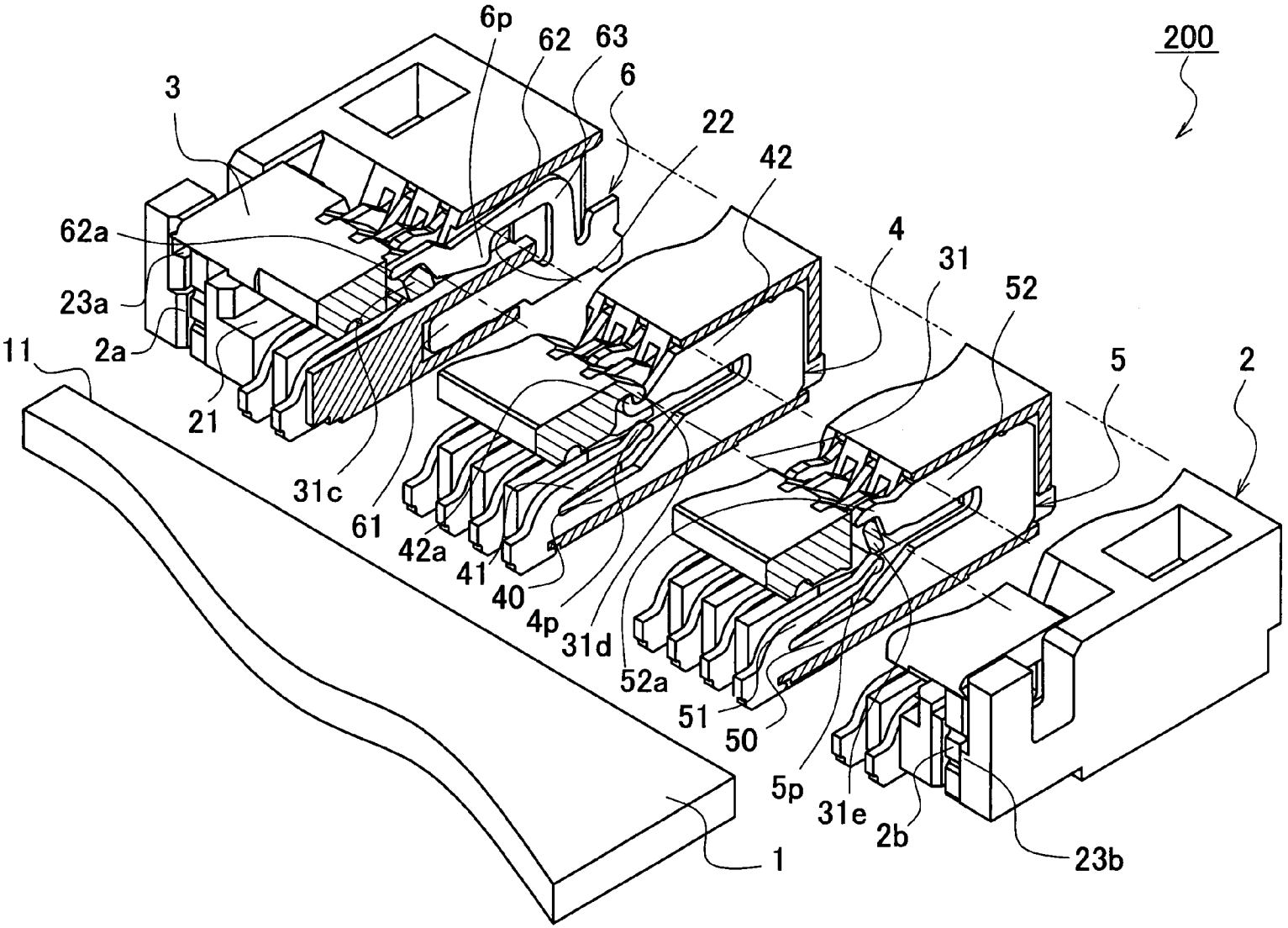
FIG. 1 is a schematic outline view showing an embodiment of a connector for FPC according to the present invention in which the principal part is cross-sectionally shown.
Figure 2:
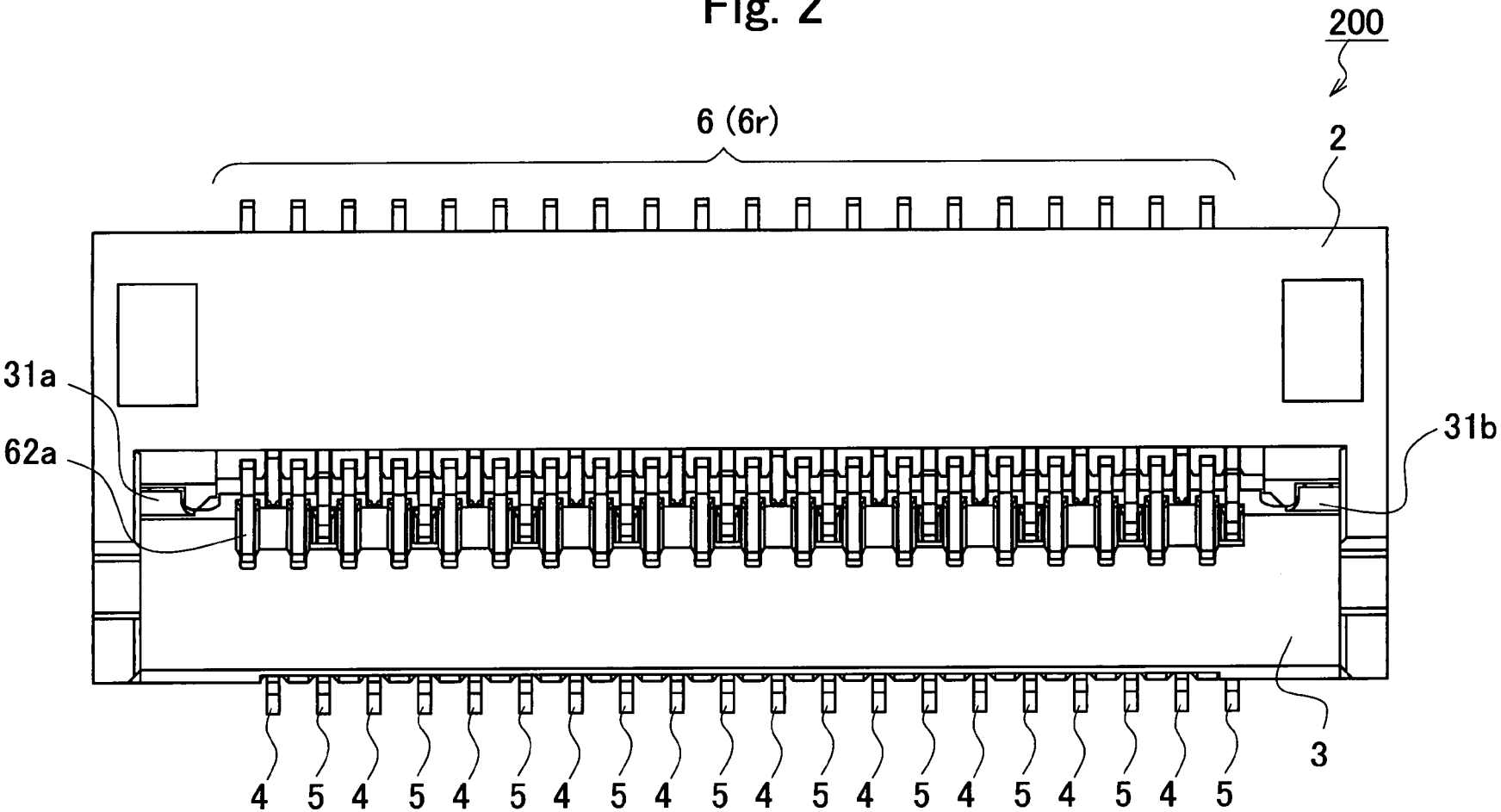
FIG. 2 is a plan view of a connector for FPC according to the present embodiment.
Figure 3:
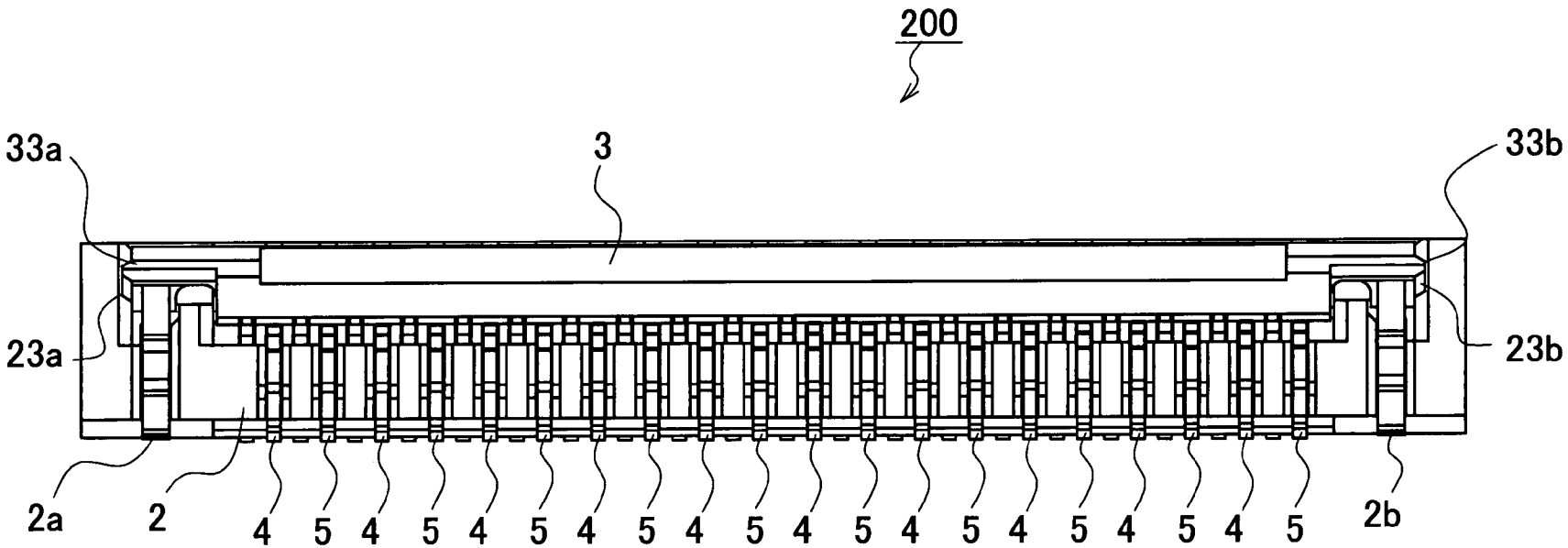
FIG. 3 is a front view of a connector for FPC according to the present embodiment.

FIG. 1 is a schematic outline view showing an embodiment of the connector for FPC (hereinafter, refers to as a connector) according to the present embodiment. FIG. 1 shows the closed position of the cover housing in which the principal part is cross-sectionally shown. FIG. 2 is a plan view of a connector wherein the cover housing is closed according to the present embodiment. FIG. 3 is a front view of a connector wherein the cover housing is closed according to the present embodiment.

Figure 4:
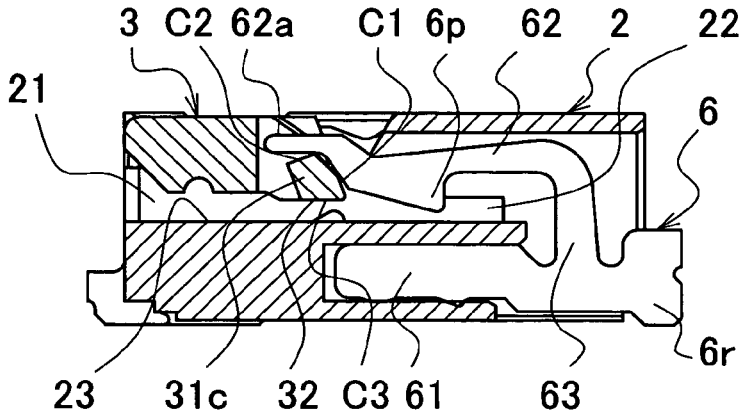
FIG. 4 is a longitudinal sectional view in which the third contact is cross-sectionally shown according to the present embodiment.
Figure 5:
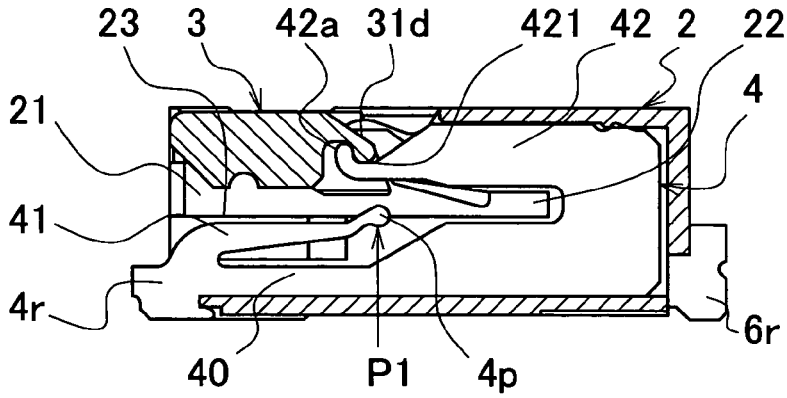
FIG. 5 is a longitudinal sectional view in which the first contact is cross-sectionally shown according to the present embodiment.
Figure 6:
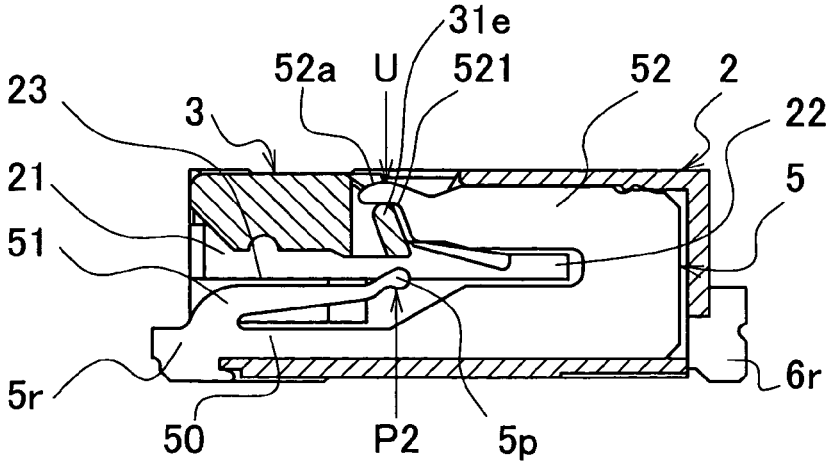
FIG. 6 is a longitudinal sectional view in which the second contact is cross-sectionally shown according to the present embodiment.

FIG. 4 is a longitudinal sectional view wherein the third contact is cross-sectionally shown according to the present embodiment. FIG. 5 is a longitudinal sectional view wherein the first contact is cross-sectionally shown according to the present embodiment. FIG. 6 is a longitudinal sectional view wherein the second contact is cross-sectionally shown according to the present embodiment.

Figure 7:
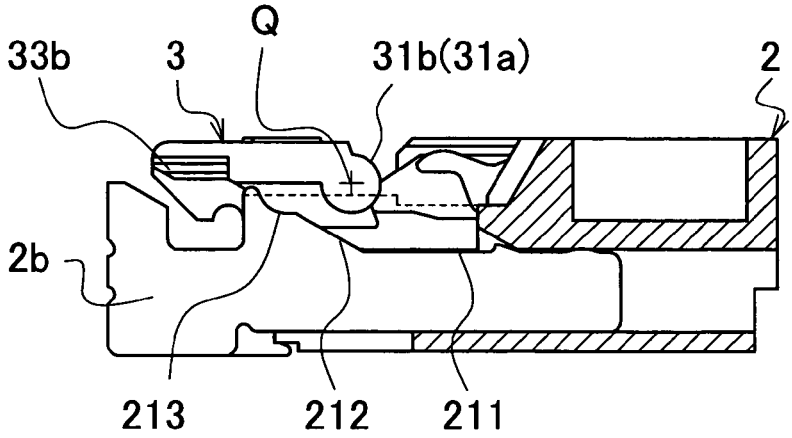
FIG. 7 is a longitudinal sectional view in which the side surface of a tab is cross-sectionally shown, in a state prior to installation of the cover housing into the housing according to the present embodiment.
Figure 8:
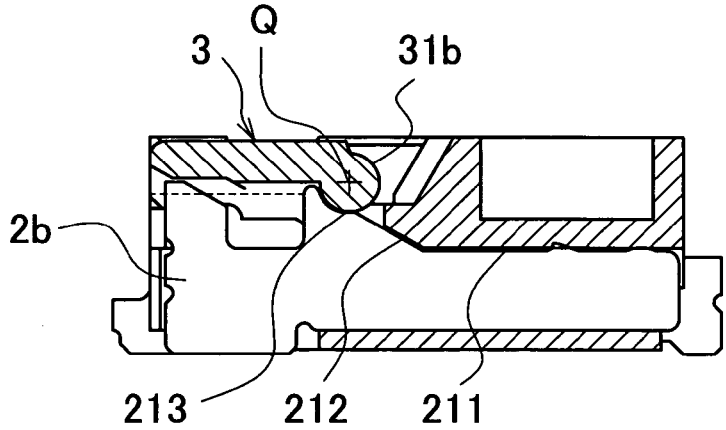
FIG. 8 is a longitudinal sectional view in which the side surface of a tab is cross-sectionally shown, in a state where the cover housing is installed into the housing.
Figure 9:
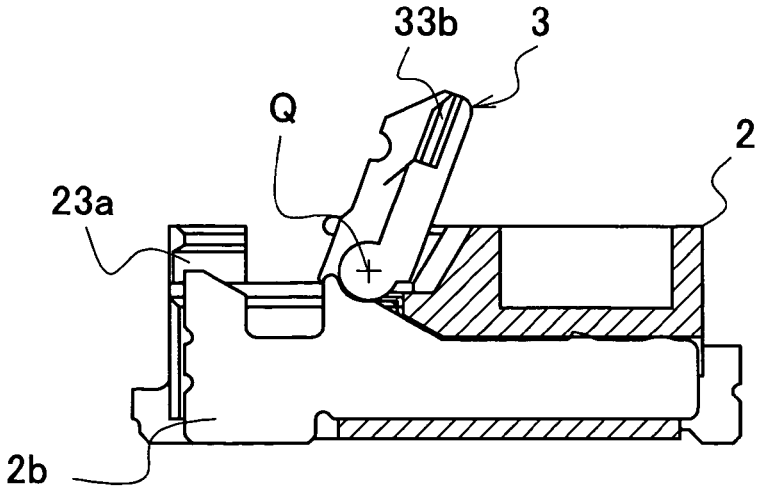
FIG. 9 is a longitudinal sectional view in which the side surface of a tab is cross-sectionally shown, in a state where the cover housing is opened.
Figure 10:
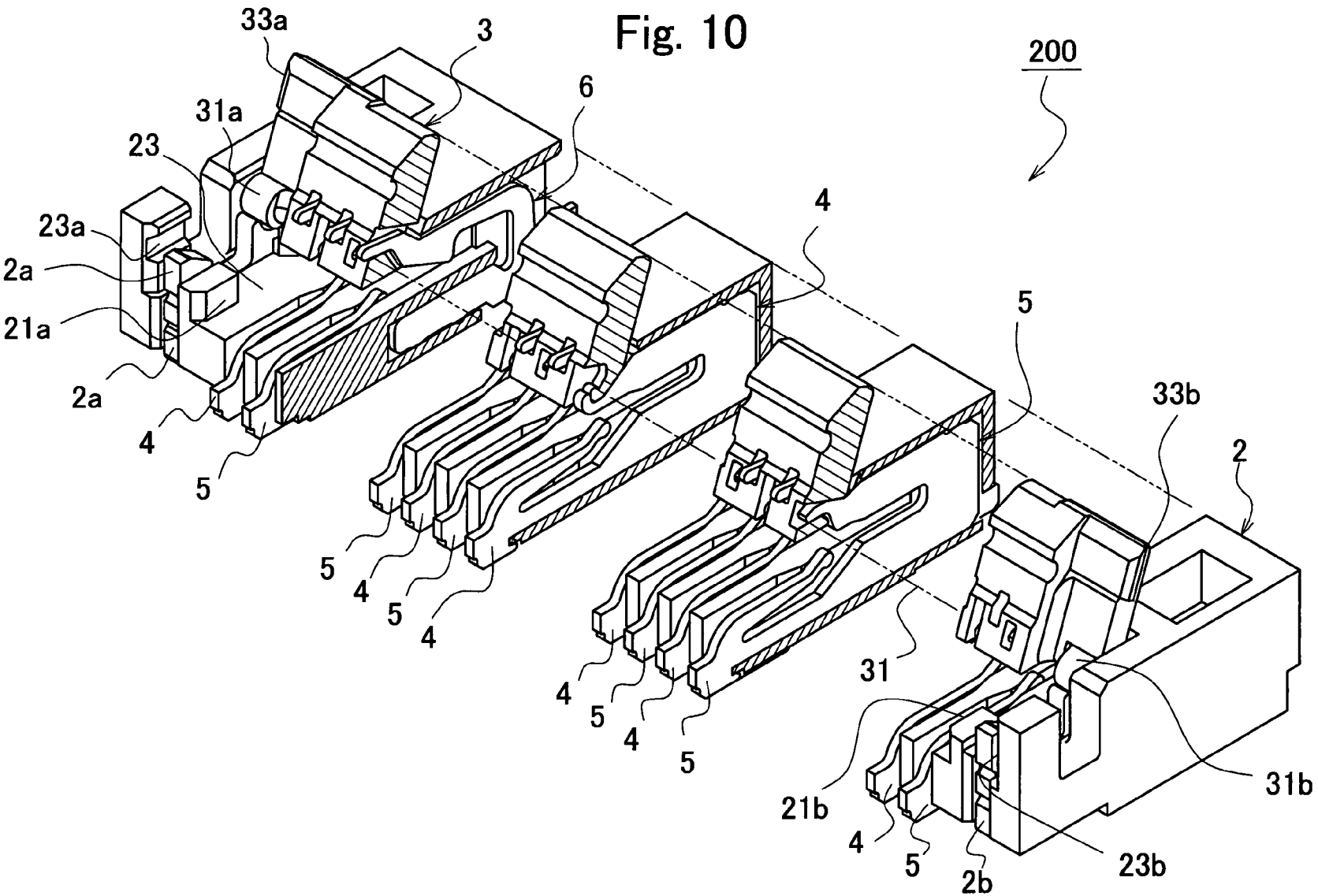
FIG. 10 is a schematic outline view showing a connector according to the present embodiment, in which the principal part is cross-sectionally shown.

FIG. 7 is a longitudinal sectional view wherein the side surface of the tab is cross-sectionally shown according to the present embodiment, in a state prior to installation of the cover housing into the housing. FIG. 8 is a longitudinal sectional view wherein the side surface of the tab is cross-sectionally shown according to the present embodiment, in a state where the cover housing is installed into the housing. FIG. 9 is a longitudinal sectional view wherein side surface of the tab is cross-sectionally shown according to the present embodiment, in a state where the cover housing is opened. FIG. 10 is a schematic outline view showing a connector according to the present embodiment. FIG. 10 shows an opening position of the cover housing in which the principal part is cross-sectionally shown.

Figure 11:
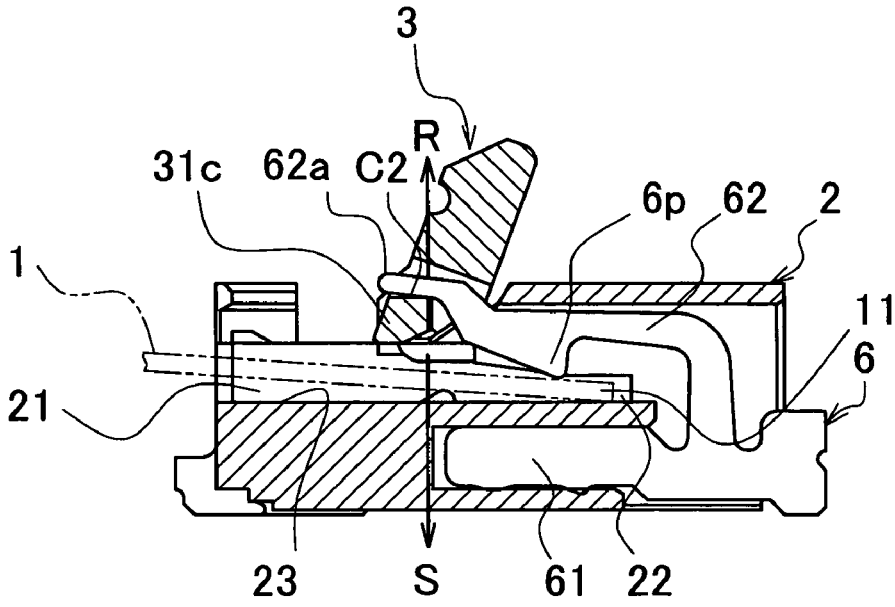
FIG. 11 is a longitudinal sectional view in which the side surface of the third contact is cross-sectionally shown according to the present embodiment, in a state where the cover housing is opened.
Figure 12:
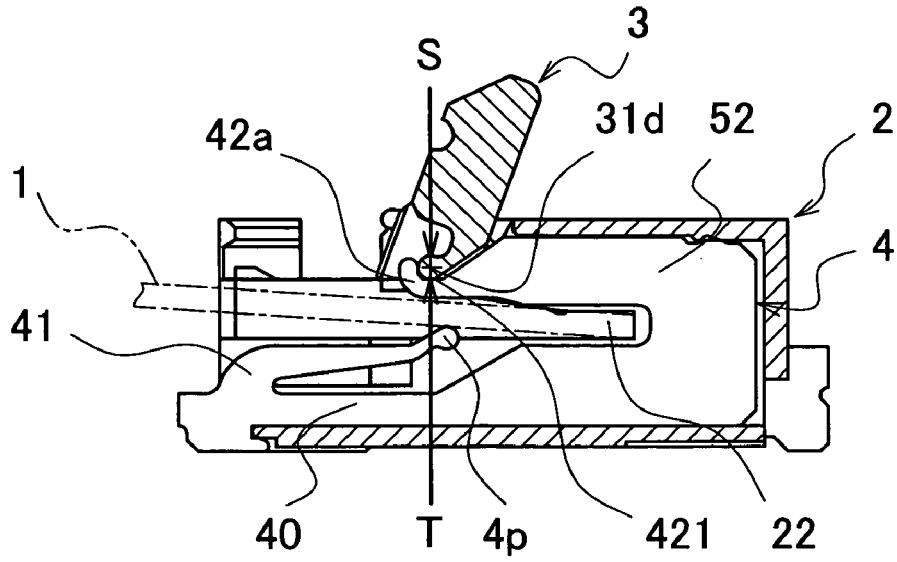
FIG. 12 is a longitudinal sectional view in which the side surface of the first contact is cross-sectionally shown according to the present embodiment, in a state where the cover housing is opened.
Figure 13:
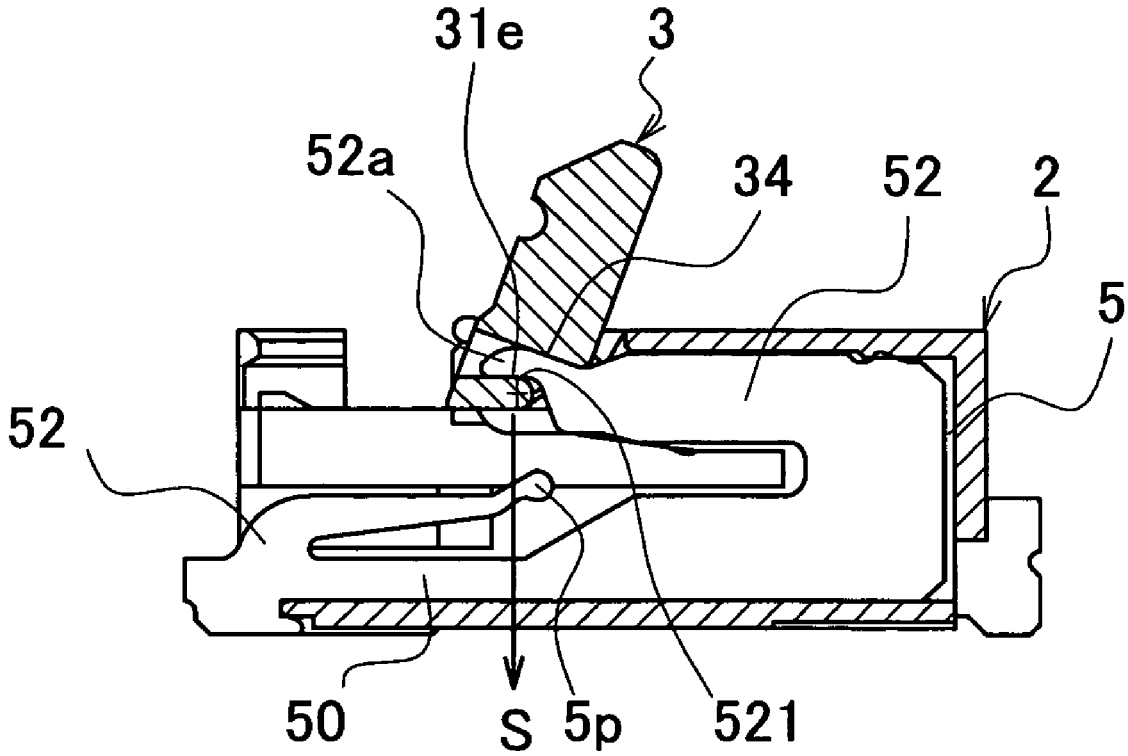
FIG. 13 is a longitudinal sectional view in which the side surface of the second contact is cross-sectionally shown according to the present embodiment, in a state where the cover housing is opened.
Figure 14:
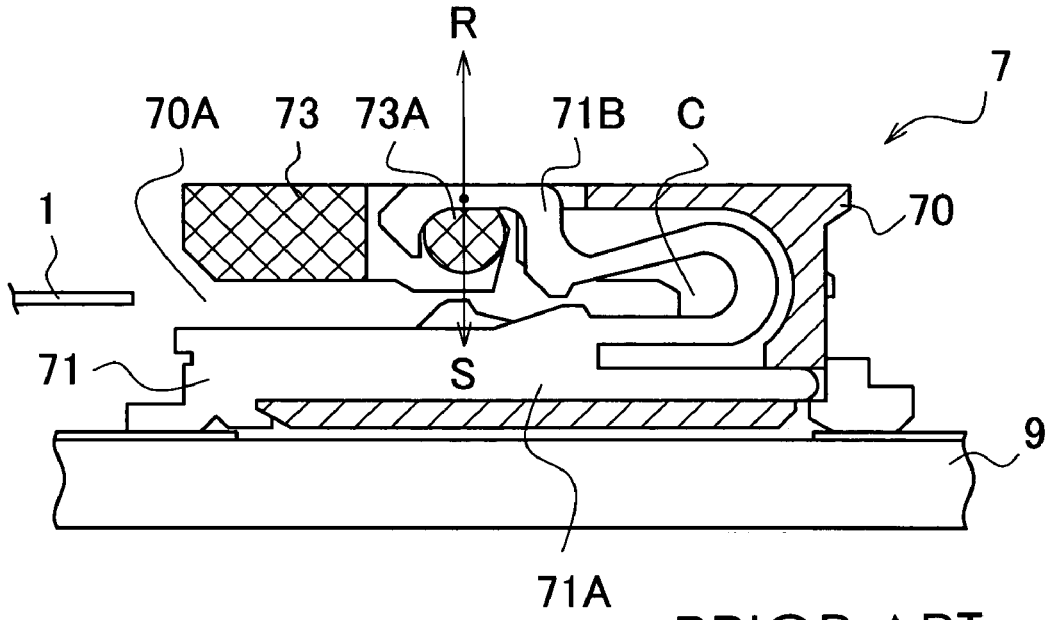
FIG. 14 is a sectional view of the connector for FPC in the conventional art.
Figure 15:
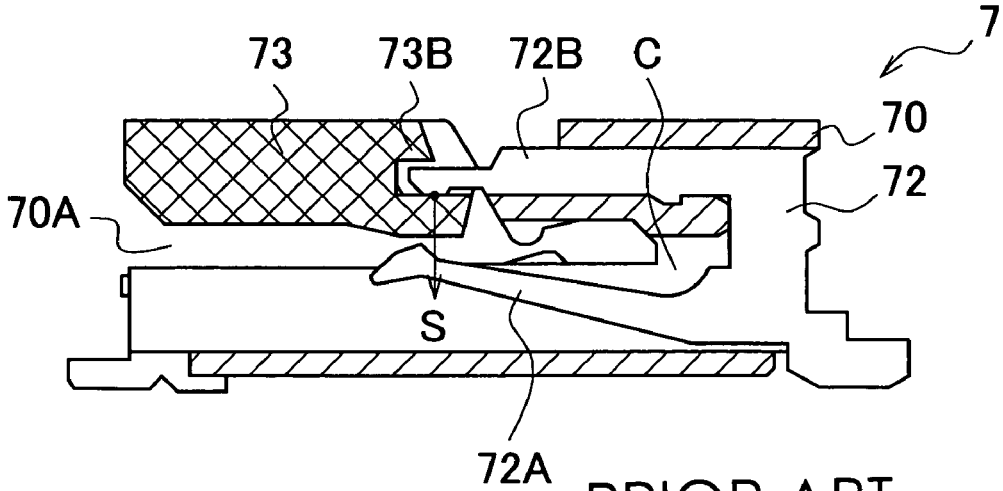
PRIOR ART Fig. 15
FIG. 15 is a sectional view of the connector for FPC in the conventional art.
Figure 16:
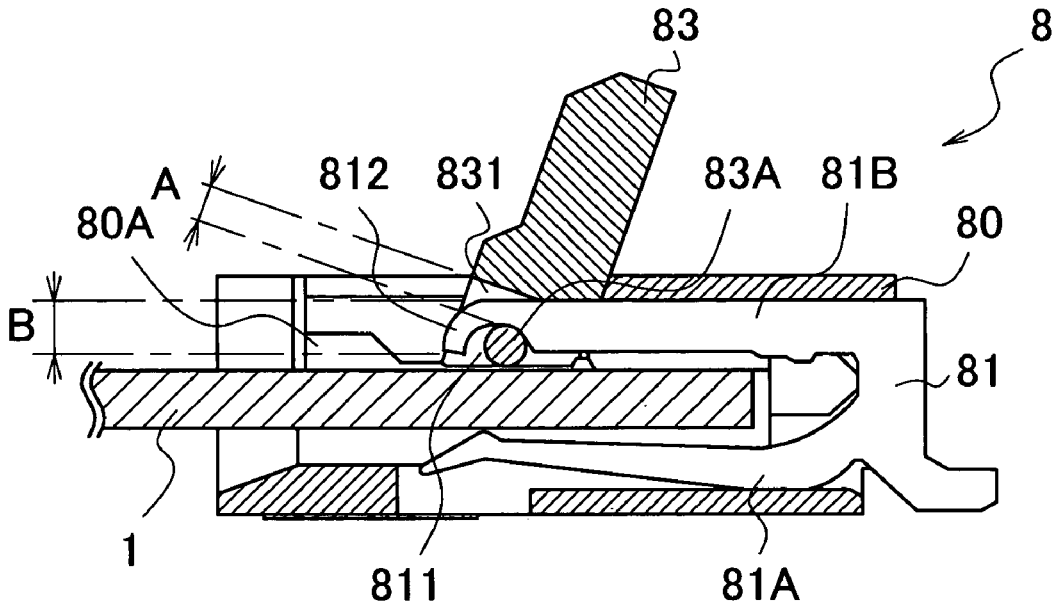
FIG. 16 is other sectional view of the connector for FPC in the conventional art.
Figure 17:
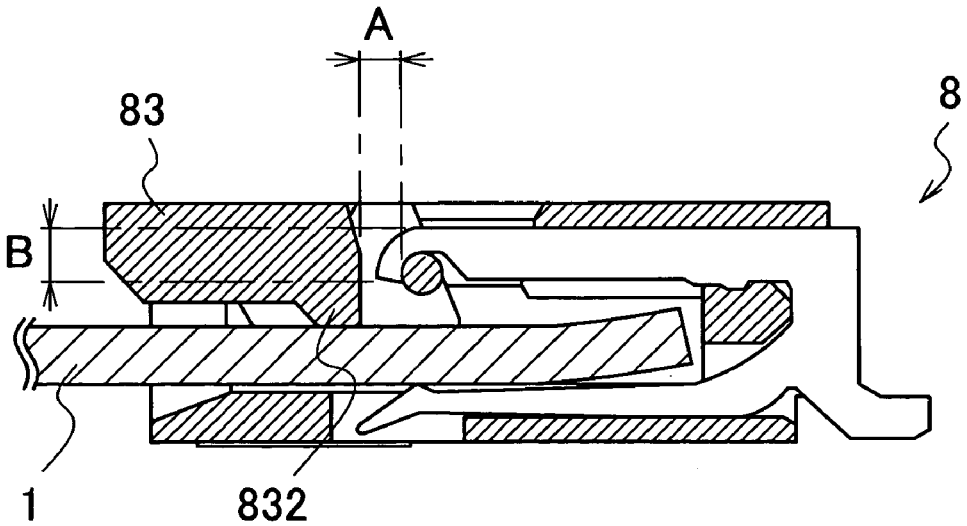
PRIOR ART Fig. 17
FIG. 17 is other sectional view of the connector for FPC in the conventional art.

FIG. 11 is a longitudinal sectional view wherein the side surface of the third contact is cross-sectionally shown according to the present embodiment, in a state where the cover housing is opened. FIG. 12 is a longitudinal sectional view wherein the side surface of the first contact is cross-sectionally shown according to the present embodiment, in a state where the cover housing is opened. FIG. 13 is a longitudinal sectional view wherein the side surface of the second contact is cross-sectionally shown according to the present embodiment, in a state where the cover housing is opened.

Firstly, a configuration of the connector according to the present invention is described. FIG. 1 shows the connector 200 that has the FPC 1 to be inserted therein and conductively connects the FPC 1, and comprises a non-insulative housing 2. The housing 2 comprises a recess 21 wherein the FPC 1 is inserted. The recess 21 is formed such a way that one end side is opened and the other end side has an insertion portion 22 that abuts the insertion end portion 11 of the FPC 1. A plurality of the first, second and third contacts 4, 5 and 6 arranged in the housing 2 are conductively connected to the FPC 1.

In FIG. 1, the housing 2 is composed of a non-insulative synthetic resin made from non-insulative material. The housing 2 is formed in a generally rectangular parallelepiped shape with a thin rectangular parallelepiped shaped recess 21 in which the FPC 1 is inserted. The FPC 1 is inserted from the opening portion side of the recess 21 toward the insertion portion 22.

Upon insertion of FPC 1 into the recess 21, a pair of vertically arranged walls 21*a*, 21*b* (refer to FIG. 10) forming the recess 21 guides the width direction of the FPC 1, and aligns the walls with the plurality of the first, second and third contacts 4, 5 and 6. The plurality of the first, second and third contacts 4, 5 and 6 arranged in the housing 2 is then conductively connected to the FPC 1.

As shown in FIGS. 11 and 12, the insertion portion 22 has a width slightly larger than the thickness of the FPC 1, and has a slope formed on a surface opposing to the recess 21 and the bottom surface 23 in a way that the FPC 1 can be inserted in a slanting position with a determined open angle from the bottom surface 23 of the recess 21. The connector 200 constitutes a ZIF connector that hardly requires a force for the insertion and removal of the FTC 1 into and from the insertion portion 22.

In FIG. 1, the connector 200 comprises a cover housing 3 of generally rectangular shaped plate. The cover housing 3 is composed of a non-insulative synthetic resin made from non-insulative material. On one end of the cover housing 3 is provided with a pivot shaft 31 of which ends rotatably supported by the housing 2. The other end of the cover housing 3 opens and closes the recess. The cover housing 3 opens to allow the FPC 1 inserted into the insertion portion 22.

In FIG. 1, the cover housing 3 comprises on a pair of cylindrical protrusions 31*a*, 31*b* (refer to FIG. 10) that is coaxial to the pivot shaft 31 on both sides of one end. The pair of cylindrical protrusions 31*a*, 31*b* is rotatably supported by the housing 2 on both ends. More specifically, a pair of tabs 2*a*, 2*b*, that is to be pressed into the housing 2 rotatably supports the pair of cylindrical protrusions 31*a*, 31*b*.

Closing of the cover housing 3 presses the FPC 1 that is inserted into the insertion portion 22 and abuts the plurality of the first, second and third contacts 4, 5 and 6. A locking mechanism is provided to maintain a closing position of the cover housing 3 upon the closing thereof. The locking mechanism will be described later.

As shown in FIGS. 1 and 2, the connector 200 comprises a plurality of first contacts 4. As shown in FIG. 5, the first contacts 4 comprises a first arm 41 and a second arm 42 that extends in a direction facing with each other. The first contact 4 has a horizontal leg 40, which connects the proximal ends of the first arm 41 and the second arm 42*b*. The first contact 4 is obtained by, for example, a precise punching of the metal thin plate.

As shown in FIG. 5, the first contact 4 is pressed from the recess 21 side into the housing 2. The first arm 41 is stood and branched from the one end of the horizontal leg 40 and is further extended and branched toward the insertion portion 22 from the opening side of the recess 21. On the extended and branched end of the first arm 41, there is provided a first contact 4*p* that extends from the bottom surface 23 of the recess 21 and elastically contacts the FPC 1.

As shown in FIG. 5, the second arm 42 is stood and branched from the other end of the horizontal leg 40 and is further extended and branched toward the first contact 4*p*. On the tip 42*a* of the second arm 42, there is provided a receiving portion 421 that rotatably engages the engaging portion 31*d*. The engaging portion 31*d* is then supported by the receiving portion 421 in a direction against the engaging portion 31*d* that moves toward the recess 21. In FIG. 5, the second arm 42 is a rigid arm having large geometrical moment of inertia.

As shown in FIG. 10, the housing 2 comprises a plurality of longitudinal rectangular grooves in a shape of teeth of comb from the opening side of the recess 21 to the insertion portion 22 and further to the backward of the insertion portion 22, into which the first contact 4 is pressed from the opening portion of the recess 21. The first contact 4*p* of the first arm 41 protrudes from the bottom surface 23 of the recess 21. (Refer to FIG. 5)

As shown in FIG. 10, the longitudinal rectangular grooves have a width slightly larger than the thickness of the first contact 4 in a way that the first arm 41 may deflect within a certain specific distance from the opening portion of the recess 21. Beyond the distance, the width of the groove is slightly smaller than the plate thickness of the first contact 4. In the rear portion of the housing 2 (opposing side of the recess 21), the upper and lower direction of the first contact 4 is pressed into the housing 2.

In FIG. 5, a U-shaped groove is formed by a horizontal leg 40 and the second arm 42 that are opposing with each other on the other end of the first contact 4 in a way that the groove surrounds the contour of the insertion portion 22 that is to be abut by the insertion end portion 11 of the FPC 1. The first contact 4 has a larger width so that the FPC 1 can be inserted in a portion wherein a U-shaped groove has a contour.

As shown in FIGS. 1 and 2, the connector 200 comprises a plurality of the second contacts 5. As shown in FIG. 6, the second contact 5 comprises a first arm 51 and a second arm 52 that extends in a direction facing with each other. The second contact 5 has a horizontal leg 50, which connects the proximal ends of the first arm 51 and the second arm 52. The second contact 5 is obtained by, for example, a precise punching of the metal thin plate.

As shown in FIG. 6, the second contact 5 is pressed from the recess 21 side into the housing 2. The first arm 51 is stood and branched from one end of the horizontal leg 50 and is further extended and branched toward the insertion portion 22 from the opening side of the recess 21. On the extended and branched end of the first arm 51, there is provided a first contact point 5*p* that protrudes from the bottom surface 23 of the recess 21 and elastically contacts the FPC 1.

As shown in FIG. 6, the second arm 52 is stood and branched from the other end of the horizontal leg 50 and is further extended and branched toward the first contact point 5*p*. On the tip side 52*a* of the second arm 52, there is provided a pressing portion 521 that rotatably presses the supporting portion 31*e*. The supporting portion 31*e* is then pressed by the pressing portion 521 in a direction against the supporting portion 31*e* that moves away from the recess 21. In FIG. 6, the second arm 52 is a rigid arm having large geometrical moment of inertia.

As shown in FIG. 10, the housing 2 comprises a plurality of longitudinal rectangular grooves in a shape of teeth of comb from the opening side of the recess 21 to the insertion portion 22 and further to the backward of the insertion portion 22, into which the first contact 5 is pressed from the opening portion of the recess 21. The first contact point 4*p* of the first arm 41 extends from the bottom surface 23 of the recess 21, and the first contact point 5*p* of the first arm 51 extends from the bottom surface 23 of the recess 21 (Refer to FIG. 6).

As shown in FIG. 10, the longitudinal rectangular grooves have a width slightly larger than the thickness of the second contact 5 in a way that the first arm 51 may deflect within a certain specific distance from the opening portion of the recess 21. Beyond the distance, the width of the groove is slightly smaller than the plate thickness of the second contact 5. In the rear portion of the housing 2 (opposing side of the recess 21), the second contact 5 in the upper and lower direction is pressed into the housing 2. (Refer to FIG. 6)

In FIG. 6, an U-shaped groove is formed by a horizontal leg 50 and the second arm 52 that are opposing with each other on the other end of the second contact 5 in a way that the groove surrounds the contour of the insertion portion 22 that is to be abut by the insertion end portion 11 of the FPC 1 (Refer to FIG. 11). The second contact 5 has a larger width so that the FPC 1 can be inserted in a portion wherein a U-shaped groove has a contour.

In FIG. 10, the first contact 4 and the second contact 5 have an equal plate thickness. The second contact 5 may, for example, be inserted into the longitudinal rectangular groove in which the first contact 4 is to be inserted. Alternatively, the first contact 4 may be inserted into the longitudinal rectangular groove in which the second contact 5 is to be inserted.

As shown in FIGS. 1 and 2, the connector 200 comprises a plurality of the third contacts 6. As shown in FIG. 4, the third contact 6 comprises a fixing arm 61 and an elastic arm 62 that opposes the fixing arm 61. The third contact 6 comprises a connecting leg 63 that connects one end of the fixing arm 61 and the elastic arm 62 The third contact 6 is obtained by, for example, a precise punching of the metal thin plate.

As shown in FIG. 4, the fixing arm 61 is pressed from the opposing side of the recess into the housing 2 to be fixed thereto. The tip 62*a* of the elastic arm 62 locks at the cam 31*c* to be formed around the pivot shaft 31 to maintain the opening and closing position of the cover housing 3. The elastic arm 62 is provided a second contact point 6*p* (Refers to FIG. 4) that extends toward the bottom surface 23 of the recess 21 and elastically contacts the FPC 1 (Refer to FIGS. 12 and 13).

In a state where the fixing arm 61 is pressed into the housing 2, the elastic arm 62 has a function of spring that serves as a so-called cantilever contact. The cam portion 31 is a plate cam having a plane curve as its contour. The cam also serves as an eccentric cam having a portion of the contour deviated from the center axis of the pivot shaft 31. The tip side 62*a* of the elastic arm 62 is a follower to be displaced due to a rotational movement of the cam 31*c*.

As shown in FIGS. 2 and 3, the housing 2 comprises a first contact 4 and a second contact 5 alternatively disposed in parallel therein. The housing 2 comprises a third contact 6 that is disposed between a pair of the first contact 4 and the second contact 5 situating adjacent to each other. In the connector 200, a plurality of the third contacts 6 may be arranged in parallel in a certain interval, and at a same time a plurality of the first contact 4 and a plurality of the second contact 5 may be alternatively arranged in parallel in an interval equal to the interval of the third contacts 6 between the plurality of the third contacts 6.

In FIGS. 2 and 3, the plurality of the third contacts 6 is disposed in a certain interval equal with the interval of the conductive pattern of FPC 1 (A conductive pattern exposed at an end 11 of the FPC 1). Here, the plurality of the first contacts 4 and the plurality of second contacts 5 disposed between the plurality of the third contacts 6 are alternatively arranged in parallel with a half pitch displacement from the plurality of the second contacts 5.

In FIG. 1, the plurality of the first contacts 4 and the plurality of second contacts 5 contact the conductive pattern that exposes on one surface of the FPC 1. In addition, the plurality of the third contacts 6 contacts the conductive pattern that exposes on the other surface of the FPC 1. The connector 200 is preferably applied to the double-sided FPC, however, may be applied to the single sided FPC.

As shown in FIG. 5 or 6, the first contact 4 and the second contact 5 comprise a first lead 4*r* and a second lead 5*r* extending from the opening side of the recess 21 toward a direction opposing the insertion of FPC (refer to FIGS. 5 and 6). On the other hand, the third contact 6 has a third lead 6*r* extending from the opposing side of the recess 21 toward the insertion direction of the FPC 1. The bottom surface of the first lead 4*r*, the second lead 5*r*, and the third lead 6*r*, respectively, are solder jointed to the printed circuit board (not shown).

The connector 200 has a plurality of the first lead 4*r*, the second lead 5*r*, and the third lead 6*r* solder jointed to the printed circuit board. With this configuration, the connector 200 achieves a connector to be surface mounted to the printed circuit board.

In FIG. 1, the connector 200 comprises a pair of tabs 2*a*, 2*b* that is disposed on both sides of the housing 2, and rotatably supports both ends of the pivot shaft 31. The pair of tabs 2*a*, 2*b* is pressed into the housing 2. The bottom surface of the pair of tabs 2*a*, 2*b* is solder jointed to the printed circuit board (not shown). The tabs 2*a* and 2*b* are identical from each other (refer to FIG. 7), however, for convenience, they are distinguished from each other as tab 2*a* and tab 2*b* to clearly show the arrangement in the connector 200.

The pair of tabs 2*a*, 2*b* may be formed of metal materials that can be easily solder jointed to printed circuit board, or may be formed of a rigid metal plate that can be pressed into the housing. The pair of tabs 2*a*, 2*b* supports the pivot shaft 31 at both ends and is pressed into the housing 2 to be connected to the printed circuit board, and therefore complementing the connection strength of the connector 200 to the printed circuit board.

The configuration of afore-mentioned lock mechanism will now be described. As shown in FIG. 10, a pair of detents 33*a*, 33*b* is extending in a direction opposing both sides of the cover housing 3. On the other hand, a pair of indents 23*a*, 23*b* that is engaged to the pair of detents 33*a*, 33*b* is formed in an internal wall surface of the opening side of the housing 2 in an opposing way.

As shown in FIG. 9 or 10, when the cover housing 3 is rotated from an opened position, a pair of detents 33*a*, 33*b* pushes the pair of indents 23*a*, 23*b* to be widely opened. The pair of detents 33*a*, 33*b* then engages the pair of indents 23*a*, 23*b* to lock the cover housing 3 in a closed position. Alternatively, the cover housing 3 is opened when a strong force that pushes the pair of indents 23*a*, 23*b* wide open is acted, and thereby releasing the locking position of the cover housing 3.

With reference to drawings, a method for assembling the connector according to the present invention will be described now.

Firstly, a plurality of the third contacts 6 is assembled into the housing 2. As shown in FIG. 4, the plurality of the third contacts 6 is pressed into the housing 2 from the opposing side of the recess 21 and fixed to the housing 2. At this step, the cover housing 3 is not yet assembled into the housing 2.

Secondly, a plurality of the second contacts 6 is assembled into the housing 2. As shown in FIG. 6, the plurality of the second contacts 6 is pressed into the housing 2 from the side of recess 21 and fixed to the housing 2.

Even at this step, the cover housing 3 is not yet assembled into the housing 2.

As shown in FIG. 7, on the upper edge of the tab 2*b*, a low profile flat surface 211 is formed, and continuously from the low profile flat surface 211, a tilted surface 212 is formed, and further continuously from the tilted surface 212, a high profile flat surface is formed, and then a circular arc surface 213 is formed to rotatably support the cylindrical protrusion 31*b*.

With such shape, on the flat surface 211 of the pair of tabs 2*a*, 2*b*, a pair of cylindrical protrusions 31*a*, 31*b* is oppositely disposed. The pair of tabs 2*a*, 2*b* is then briefly inserted into the housing 2 (refer to FIG. 7). On the other hand, as shown in FIG. 5, a plurality of first contacts 4 has an engaging portion 31*d* engaged with the receiving portion 421, and is then briefly inserted into the housing 2. At this step, as shown in FIG. 7, the cover housing 3 is spaced apart from the housing 2 by a certain distance.

Then, when the pair of tabs 2*a*, 2*b* is inserted (pressed) into the housing 2, a pair of cylindrical protrusions 31*a*, 31*b* abuts the housing 2, and following the tilted surface 212, the pair of cylindrical protrusions 31*a*, 31*b* has an axial center Q slightly moving upward toward the arc-shaped surface 213. At this point, a plurality of first contacts 4 is pressed into the housing 2.

At a step where the pair of tabs 2*a*, 2*b* and the plurality of first contacts 4 are completely inserted (pressed) into the housing 2, the center of axis including engaging portion 31*d* (refer to FIG. 5) is supported from an upper part by the tip side 62*a* of the elastic arm 62 and the tip side 52*a* of the second arm 52.

On the other hand, the pair of cylindrical protrusions 31*a*, 31*b* is supported from a lower part by the arc-shaped surface 213 that is formed on the pair of tabs 2*a*, 2*b*. In addition, the engaging portion 31*d* is supported from a lower part by the receiving portion 421.

With reference to drawings, an action of the connector according to the present invention will be described.

As shown in FIG. 1, the pivot shaft 31 of the cover housing 3 includes an engaging portion 31*d* that engages the receiving portion 421 (refer to FIG. 5) of the first contact 4, a supporting portion 31*e* that is pressed by the pressing portion 521 (refer to FIG. 6) of the second contact 5, and a cam portion 31*c* that locks on the tip side 62*a* (refer to FIG. 4) of the elastic arm 62 in the third contact 6. The pivot shaft 31 of the cover housing 3 further includes a pair of cylindrical protrusions 31*a*, 31*b* disposed on both sides of one end of the cover housing 3. These engaging portion 31*d*, supporting portion 31*e*, cam portion 31*c*, and cylindrical protrusions 31*a*, 31*b* are disposed in an axial direction of the pivot shaft 31.

As shown in FIG. 4, when the FPC 1 is not inserted and the cover housing 3 is closed, the tip side 62*a* of the elastic arm 62 abuts the first contour C1 of the cam portion 31*c* and maintains the closed position of the cover housing 3. The tip side 62*a* of the elastic arm 62 abuts the cam portion 31*c*, however, does not energize the pivot shaft 31.

When the cover housing 3 is opened from a position shown in FIG. 4, the tip side 62*a* of the elastic arm 62 is pushed upward by the second contour C2 that is formed by the cam portion 31*c* to be in a position shown in FIG. 11. In FIG. 11, the elastic arm 62 presses the second contour C2 of the cam portion 31*c* to maintain the opened position of the cover housing 3.

In FIG. 11, due to the rotated cam portion 31*c*, the tip side 62*a* of the elastic arm 62 is energized with a force R that is to move away from the recess 21. The elastic arm 62 is then deflected in an upward direction, which widens the interval between the second contact point 6*p* and the bottom surface 23 of the recess 21, thus allowing the insertion of the FPC 1.

On the other hand, in FIG. 11, due to a returning force (or a counteraction) of the elastic arm 62, a force S that moves toward the recess 21 is acted upon the cam portion 31*c*. The force S that moves toward the recess 21 acts as a uniformly distributed load in an axial direction of the pivot shaft 31 that has both ends supported thereto.

The force R that displaces the elastic arm 62, and the force S that presses the cam portion 31*c* as a counteraction are increased during a step of opening the cover housing 3. It is therefore not sufficient to open the cover housing 3 by merely arranging a plurality of the elastic arms 62 into the housing 2. This is because that the central portion in an axial direction of the pivot shaft 31 deflects, causing an engagement of the cam 31*c* that is disposed in the central portion and the tip side 62*a* of the elastic arm 62. As a result, the cover housing 3 is failed to be opened.

On the other hand, as shown in FIG. 12, the engaging portion 31*d* is supported by the receiving portion 421 in a direction against the engaging portion 31*d* that moves toward the bottom surface 23 of the recess 21. In FIG. 12, the first contact 4 is provided in such a way that the elastic force T of the tip side 42*a* of the second arm 42 acts in opposite to the force S of the engaging portion 31*d* that moves toward the bottom surface 23 of the recess 21.

Alternatively, in FIG. 12, the second arm 42 is a cantilever beam having a receiving portion 421 of free end on which load is acted upon. Assuming that the rectangular cross sectional surface, for example, has a plate thickness of "b" and a plate width of "h", the geometrical moment of inertia I of the second arm 42 is calculated with a formula I=bh3/12. The widened second arm has a cross sectional shape with larger geometrical moment of inertia. In addition, the extending end of the second arm 42 shortens the extending distance from the housing 2, and decreases the amount of deflection in the receiving portion 421 upon which load is acted.

Furthermore, as shown in FIG. 1, the first contact 4 is disposed closely to the third contact 6 and at the same time, is disposed in generally uniformly in relation to the axial direction of the pivot shaft 31 that has both ends supported, thereby preventing deflection of the pivot shaft 31 toward a direction of the recess 21.

Alternatively, as shown in FIG. 13, the force S acting upon the aforementioned cam portion 31*c* acts as a force S wherein the tilted wall 34 formed in the cover housing 3 pushes down the tip side 52*a* of the second arm 52. However, because the second arm 52 is a cantilever beam having the tip side 52*a* that is under load, and the second arm 52 is a rigid arm having large geometrical moment of inertia so that the tip side 52*a* will not be displaced easily at a opening position of the cover housing 3.

From an opening position of the cover housing 3 as shown in FIGS. 11 to 13, when the FPC 1 is inserted into the recess 21 and the cover housing is closed, a plurality of the elastic arms 62 returns and a plurality of the second contact points 6*p* presses one surface of the FPC 1 to obtain conductive connection (refer to FIG. 4).

As shown in FIG. 4, the third contour C3 that is continuous from the first contour C1 and the second contour C2 that is formed on the cam portion 31*c* forms a pressing portion 32 that presses the FPC 1 toward the bottom surface 23 side of the recess 21. In addition, a plurality of the first contact points 4*p*, 5*p* presses the other surface of the FPC 1 from the opposing side of the pressing portion 32 to obtain conductive connection (refer to FIGS. 5 and 6).

When the FPC 1 is inserted and the cover housing 3 is closed, a counterforce P1 (refer to FIG. 5) of the first contact point 4*p* and a counterforce P2 (refer to FIG. 6) of the first contact point 5*p* act upon the pivot shaft 31. The counterforce P1 and P2 are uniformly distributed loads in an axial direction of the pivot shaft 31, acting as a force in which the pivot shaft 31 moves away from the bottom surface 23 of the recess 21. The counterforce P1 and P2 act in a way that the center in an axial direction of the pivot shaft 31 is deflected. Still at this point, because the tip side 62*a* of the elastic arm 62 is spaced apart from the cam portion 31*c*, no force that acts against the counterforce P1 and P2 will be provided.

However, as shown in FIG. 6, the supporting portion 31*e* is pressed by the pressing portion 521 in a direction against the supporting portion 31*e* that moves away from the recess 21. In FIG. 6 the second contact 5 is provided in such a way that the elastic force U of the tip side 52*a* in the second arm 52 acts in opposite to the force P1 and P2 of the supporting portion 31*e* that moves away from the recess 21.

Alternatively, in FIG. 6, the second arm 52 is a cantilever beam having a pressing portion 521 of free end on which load is acted upon. Assuming that the rectangular cross sectional surface, for example, has a plate thickness of "b" and a plate width of "h", the geometrical moment of inertia I of the second arm 52 is calculated with a formula I=bh3/12. The widened second arm 52 has a cross sectional shape with larger geometrical moment of inertia. In addition, the extending end of the second arm 52 shortens the extending distance from the housing 2, and decrease the amount of deflection in the pressing portion 521 upon which load is acted.

Furthermore, as shown in FIG. 1, the third contact 6 is disposed closely to the first contact 4 and at the same time, is disposed in generally uniformly in relation to the axial direction of the pivot shaft 31 that has both ends supported, thereby preventing deflection of the pivot shaft 31 toward a direction away from the recess 21. This also serves to prevent the contact failure of the first contact point 4*p* and the second contact point 5*p*.

The connector according to the present invention is a low profile connector for FPC and comprises a contact that has more pins in finer pitch therebetween. The connector further comprises a plurality of the first and second contacts alternatively disposed in parallel, which sandwiches the pivot shaft in a direction against the deflection of the pivot shaft in a way that the pivot shaft in the cover housing that can be opened and closed will not be displaced. In addition, a plurality of the third contact that maintains the opening and closing position of the cover housing is disposed between the first and the second contacts. Under such configuration, the opening and closing of the cover housing is ensured and the contact point can contact the FPC in a correct and ensured manner.

The present invention achieves a connector for FPC that has an interval of conductor on front and back surface formed in a pitch of 0.2 mm and capable of conductive connection with double-sided FPC. In addition, the connector for FPC is capable of conductive connection with double sided FPC wherein the number of conductor is eighty. Overall, it is assumed that a connector for FPC having such configuration is able to be formed with an interval in a pitch of 0.2 mm on front and back surface and is also able to be conductively connected to a double sided FPC that has a conductor of up to 120.

What is claimed is:

1. A connector comprising:

a housing and a cover housing, the housing being generally rectangular parallelepiped in shape and having a recess formed for insertion of a FPC, the cover housing being generally rectangular in shape for openably and closably covering said recess of the housing;

said housing comprising a first contact, a second contact and a third contact therein, the first and the second contacts being alternatively disposed, the third contact being disposed between a pair of said first and second contacts;

said first contact and said second contact including a first arm, a second arm, and a horizontal leg, the first arm and the second arm extending in a direction facing toward each other, the horizontal leg connecting the base end of the first and the second arm;

said third contact including a fixing arm, an elastic arm opposing the fixing arm, and a connection leg connecting said fixing arm with said elastic arm;

said second arm of the first contact having at tip a receiving portion extending toward a direction opposing a bottom surface of the recess of said housing; and said second arm of the second contact having at tip a pressing portion extending toward a bottom surface of the recess of said housing; and said cover housing comprising an engaging portion, a supporting portion, and a cam, the engaging portion extending toward a bottom surface side of the recess of said housing for engaging a receiving portion of said first contact, the supporting portion arranged between the pressing portion of said second contact and the bottom surface of the recess of said housing, and pressed by said pressing portion, the cam arranged between the elastic arm of said third contact and the bottom surface of the recess of said housing for locking at a tip of said elastic arm, wherein said first arm pivots adjacent to a front end of said housing.

2. A connector according to claim 1, wherein the second arm of said first contact and the second arm of said second contact is a rigid arm having large geometrical moment of inertia.

3. A connector according to claim 1, wherein said cam comprises a first contour and a second contour, the first contour maintains the closed position of said cover housing, and the second contour continues from the first contour and maintains the opened position of said cover housing, upon a tip side of said elastic arm engaging the second contour, the tip side of the elastic arm is elastically deformed in a direction away from a bottom surface of said recess for allowing of insertion and removal of said FPC.

4. A connector according to claim 1, wherein third contour that is continuous from said first contour and second contour forms a pressing portion that presses said FPC against the bottom surface side of said recess.

5. A connector according to claim 1, wherein said first and second contact includes a first lead and a second lead extending from the opening side of said recess toward a direction opposing to the insertion of said FPC, and said third contact includes a third lead extending from the opposing side of opening side of said recess toward a direction of the insertion of said FPC, the bottom surfaces of the first to third leads are connected to a printed circuit board.

6. A connector according to claim 1, wherein said connector includes a pair of tabs disposed on both sides of said housing and rotatably support pivot shafts that are formed on both ends of said cover housing, the pair of tabs having bottom surface connected to said printed circuit board.

7. A connector according to claims 1, wherein said connector is capable of conductive connection with double sided FPC in which a pitch between the patterns is approximately 0.2 mm.

8. A connector according to claim 1, wherein said connector is capable of conductive connection with double sided FPC that have eighty conductor lines.

* * * * *